US006277810B2

(12) United States Patent
Baines et al.

(10) Patent No.: US 6,277,810 B2
(45) **Date of Patent: *Aug. 21, 2001**

(54) DRYER-ADDED FABRIC CARE COMPOSITIONS CONTAINING AMIDE-EPICHLOROHYDRIN RESINS

(75) Inventors: Fiona Louise Baines; Jane Louise Cowen; Robert John Crawford; Andrew Philip Parker; Philip John Sams, all of Bebington (GB)

(73) Assignee: Unilever Home & Personal Care USA, division of Conopco, Inc., Greenwich, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 19 days.

(21) Appl. No.: 09/397,708

(22) Filed: Sep. 16, 1999

(30) Foreign Application Priority Data

Sep. 16, 1998 (GB) ..... 9820206
May 17, 1999 (GB) ..... 9911474

(51) Int. Cl.[7] ..... C11D 3/37
(52) U.S. Cl. ..... 510/475; 510/519; 510/528
(58) Field of Search ..... 510/475, 528, 510/519

(56) References Cited

U.S. PATENT DOCUMENTS

| | | |
|---|---|---|
| 3,949,014 | 4/1976 | Maki et al. . |
| 4,371,517 | 2/1983 | Vanlerberghe et al. . |
| 4,531,946 | 7/1985 | Christie et al. . |
| 4,605,418 | 8/1986 | Christie et al. . |
| 4,735,738 | 4/1988 | Willman . |
| 5,393,304 | 2/1995 | Vuilaume et al. . |

FOREIGN PATENT DOCUMENTS

| | | |
|---|---|---|
| 221922 | 5/1985 | (DD) . |
| 0068232 | 1/1983 | (EP) . |
| 0315477 | 5/1989 | (EP) . |
| 0341205 | 11/1989 | (EP) . |
| 0372782 | 6/1990 | (EP) . |
| 04597822 | 12/1991 | (EP) . |
| 1379203 | 1/1975 | (GB) . |
| 2063892 | 6/1981 | (GB) . |
| 2089855 | 6/1982 | (GB) . |
| 2268516 | 1/1994 | (GB) . |
| 63-028989 | 2/1988 | (JP) . |
| 96/15309 | 5/1996 | (WO) . |
| 96/15310 | 5/1996 | (WO) . |
| 96/21715 | 7/1996 | (WO) . |
| 96/26831 | 9/1996 | (WO) . |
| 97/42287 | 11/1997 | (WO) . |
| 97/42289 | 11/1997 | (WO) . |
| 98/29530 | 7/1998 | (WO) . |
| 99/06519 | 2/1999 | (WO) . |
| 99/09127 | 2/1999 | (WO) . |
| 99/15611 | 4/1999 | (WO) . |
| 99/15612 | 4/1999 | (WO) . |

OTHER PUBLICATIONS

Wet Strength Resins and Their Application, ed L L Chan. Tappi Press, Atlanta, 1994 No Month Available.

European Search Report dated Dec. 6, 1999 (PCT/EP 99/06429).

European Search Report dated Dec. 6, 1999 (PCT/EP 99/06430).

European Search Report dated Dec. 6, 1999 (PCT/EP 99/06431).

*Primary Examiner*—John Hardee
(74) *Attorney, Agent, or Firm*—Edward A. Squillante

(57) ABSTRACT

Fabric care products and sprayable compositions comprise at least one amine- or amide-epichlorohydrin resin or derivative thereof. The fabric care products are adapted for use in a tumble dryer and may comprise a substrate, such as a flexible sheet or sponge or a dispenser such as a dosing ball, for delivery of the resin. The sprayable compositions are applied to the fabric prior to tumble drying. The products and compositions may be used in a laundering process to improve the appearance and/or texture of fabrics.

13 Claims, No Drawings

DRYER-ADDED FABRIC CARE COMPOSITIONS CONTAINING AMIDE-EPICHLOROHYDRIN RESINS

TECHNICAL FIELD

This invention relates to fabric care products and compositions, to methods of treating fabric using the products and compositions in a laundering process and to the use of the products and compositions to improve the appearance and/or texture of fabrics. Improvements in appearance and/or texture include improved surface colour definition of fabrics following multiple washings and/or improved fabric dimensional stability and/or reduced fabric fibrillation.

BACKGROUND AND PRIOR ART

The laundry process generally has several benefits for fabric, the most common being to remove dirt and stains from the fabric during the wash cycle and to soften the fabric during the rinse cycle. However, there are numerous disadvantages associated with repeated use of conventional laundry treatment compositions and/or the actual laundry process; one of these being a fairly harsh treatment of fabric in the laundry process.

Fabrics can be damaged in several ways as a result of repeated laundering and/or wear. Fabric pilling and loss of fabric surface appearance e.g. fuzzing, shrinkage (or expansion), loss of colour from the fabric or running of colour on the fabric (usually termed dye transfer) are some of the common problems associated with repeated laundering. These problems may occur merely from repeated hand washing as well as the more vigorous machine washing process. Furthermore, problems relating to damage of fabric over time through normal use, such as loss of shape and increased likelihood of wrinkling are also significant.

The present invention is directed towards alleviating one or more of the problems referred to hereinabove.

Laundry detergent compositions containing polyamide-polyamine fabric treatment agents are described in WO 98/29530. The compositions are claimed to impart improved overall appearance to fabrics laundered using the detergent compositions, in terms of surface appearance properties such as pill/fuzz reduction and antifading. Laundry compositions containing polyamide-polyamine treatment agents of similar types are taught in WO 97/42287.

An industrial process for treating fibres is disclosed in U.S. Pat. No. 3,949,014. This document describes the use of a polyamine-epichlorohydrin resin in a binder, together with an amphoteric high molecular weight compound having at least 2 cationic groups and at least 2 anionic groups per molecule. U.S. Pat. No. 3,949,014 mentions the treatment of fabrics with the binder but it is clear that the treatment is intended to be carried out industrially as part of a fabric treatment process rather than as part of a domestic laundering process and this conclusion is supported by the fact that the fabric treated with the binder required curing at a relatively high temperature. Industrial curing of fabrics treated with this type of polymer system is normally caried out at about 150° C.

Methods for treating wool with compositions containing an amino functional polymer so as to impart shink resistance are known. However, as described in EP-A-0315477, wool requires a pretreatment before such compositions can be used. Furthermore, EP-A-0372782 explains that the chemistry of wool is quite different from that of cellulosic fibres such as cotton and the requirements for shrink resistance treatments for cotton are generally very different from those for wool.

Anti-wrinkle sprays containing a silicone and a film-forming polymer are described in WO 96/15309 and WO 96/15310. A wide range of possibilities is given for the film-forming polymer.

U.S. Pat. No. 4,371,517 discloses shampoo compositions and compositions for treating fabrics containing cationic and anionic polymers. In a non-domestic treatment, the compositions increased the rigidity of cotton fabric.

DD 221922 relates to co-emulsifiers, for use in fabric softener and other compositions, which contain cationic quaternary ammonium polymers.

The present invention aims to provide novel delivery systems for certain fabric care compositions.

The principal advantage of the present invention relates to maintaining the surface integrity/appearance of the treated fabric upon repeated washings to give a fabric surface that shows improved colour definition (compared to fabrics treated with conventional compositions) as a result of treatment with the compositions of the present invention.

The compositions of the invention also provide, in addition to the aforementioned advantage, the benefit of improved dimensional stability of the fabric as a result of treatment with the compositions of the invention. The term "dimensional stability", and related terms, used herein covers not only shrinkage of fabrics but also shape retention, bagginess reduction and additionally, although less preferred, crease/wrinkle resistance in fabrics.

DEFINITION OF THE INVENTION

According to the present invention, there is provided a fabric care product adapted for use in a tumble dryer comprising a composition that comprises at least one amine- or amide-epichlorohydrin resin or derivative thereof.

The invention also provides a sprayable composition, adapted for application to a fabric prior to tumble drying in a laundering process and contained in a spray dispenser, comprising at least one amine- or amide-epichlorohydrin resin or derivative thereof with the proviso that the composition does not contain a silicone.

In another embodiment, the invention relates to a method of treating fabric comprising applying to the fabric a composition comprising at least one amine- or amide-epichlorohydrin resin or derivative thereof by drying the fabric in the presence of a fabric care product of the invention or by spraying the fabric with a sprayable composition of the invention prior to drying the fabric, as part of a laundering process.

Further provided by the invention is the use of a fabric care product or a sprayable composition of the invention in the treatment of fabric to improve the appearance and/or texture of the fabric, such as, for example, surface color definition following multiple washings.

DETAILED DESCRIPTION OF THE INVENTION

The products and compositions of the present invention comprise at least one amine- or amide-epichlorohydrin resin or derivative thereof.

In the context of the present invention these first materials are polymeric, or at least oligomeric, in nature. Preferably, they have a weight average mean molecular weight of from 300 to 1,000,000 daltons.

The resins of the invention are sometimes referred to below as amine-epichlorohydrin resins and polyamine-epichlorohydrin (PAE) resins (the two terms being used synonymously) although these terms encompass both the amine and amide resins of the invention. The resins may also have a mixture of amine and amide groups.

The amine or amide-epichlorohydrin resins may have one or more functional groups capable of forming azetidinium groups and/or one or more azetidinium functional groups.

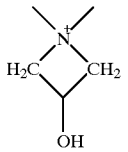

Alternatively, or additionally the resins may have one or more functional groups that contain epoxide groups or derivatives thereof e.g. Kymene™ 450 (ex Hercules).

Suitable polyamine-epichlorohydrin (PAE) resins include those described in 'Wet Strength Resins and Their Application', pp 16–36, ed. L. L. Chan, Tappi Press, Atlanta, 1994. Suitable PAE resins can be identified by selecting those resins which impart increased wet strength to paper, after treatment, in a relatively simple test.

Any amine or amide-epichlorohydrin resin having an epoxide functional group or derivative thereof is suitable for use according to the invention.

A particularly preferred class of amine or amide-epichlorohydrin resins for use in the invention are secondary amine or amide-based azetidinium resins, for example, those resins derived from a polyalkylene polyamine e.g. diethylenetriamine (DETA), a polycarboxylic acid e.g. adipic acid or other dicarboxylic acids, and epichlorohydrin. Other polyamines or polyamides can also be advantageously used in the preparation of suitable PAE resins.

Another preferred class of amine or amide-epichlorohydrin resins for use in the invention are those having an epoxide functional group or derivative thereof e.g. chlorohydrin.

The resin is preferably present in the product in a sufficient quantity to give an amount of 0.0005% to 5% by weight on the fabric based on the weight of the fabric, more preferably 0.001% to 2% by weight on fabric. The amount of the first component in the composition required to achieve the above % by weight on fabric will typically be in the range 0.01% to 35% by weight, preferably 1% to 20% by weight.

The resins may be PDAA-epichlorohydrin resins or PMDAA-epichlorohydrin resins. PDAA is poly (diallylamine) and PMDAA is poly(methyldiallyl(amine)).

The compositions of the invention, when applied to a fabric, can impart benefits to the fabric when uncured. However, they may be cured by a domestic curing step including ironing and/or domestic tumble drying, preferably tumble drying. The curing is preferably carried out at a temperature in the range of from 50 to 100° C., more preferably from 80 to 100° C.

The composition for use in the fabric care product of the invention may further comprise a silicone component. It is preferred if the silicone component is a dimethylpolysiloxane with amino alkyl groups. It may be used in the context of the present invention as an emulsion in water.

It is preferred if the silicone component is present in a ratio of first component: silicone of from 1:1 to 30:1, preferably 1:1 to 20:1, more preferably 2:1 to 20:1 and most preferably 5:1 to 15:1.

The fabric care product of the invention, which is adapted for use in a tumble dryer, preferably comprises a substrate for delivery of the resin. The substrate may be a flexible sheet or sponge, such as of fibres of polyester and/or rayon, for example. The sheet or sponge acts as a carrier for the resin and delivers the resin to the fabric on being agitated with the fabric in a tumble dryer. Alternatively, the substrate may be a dispenser, for example a receptacle, which, in use, houses the resin, having apertures therein for delivery of the resin during tumble drying. Suitable dispensers, which can be ball-shaped, are well-known to those skilled in the art. The substrate may take other forms, such as, for example, a sachet containing the resin, preferably with the resin on or in a carrier.

The fabric care product of the invention can be in other forms suitable for use in a tumble dryer. For instance, the product can be in the form of a foam containing the resin. Liquid foams can be obtained in conventional ways such as by spraying from a pressurised dispenser. The foam can also be solid or semi-solid and examples of this form of the product are the "puffs" marketed by Seabrook Industries Inc which disintegrate completely during tumble drying.

The sprayable composition of the invention is provided in a spray dispenser. Spray dispensers for compositions for application to fabrics are well-known to those skilled in the art, as are the further additives which they may contain. The sprayable composition may be applied to the fabric in the form of a foam by the addition of foaming agents to the composition and the use of a suitably adapted dispenser.

The compositions of the invention may comprise a textile compatible carrier. In the context of the present invention the term "textile compatible carrier" is a component which can assist in the interaction of the resin with the fabric. The carrier can also provide benefits in addition to those provided by the resin e.g. softening, etc. The carrier may be water or, preferably, a fabric softener or conditioning compound or other suitable fabric treatment agent which can be used in a tumble dryer.

The fabrics which may be treated in the present invention preferably comprise cellulosic fibres, preferably from 1% to 100% cellulosic fibres (more preferably 5% to 100% cellulosic fibres, most preferably 40% to 100%). When the fabric contains less than 100% cellulosic fibres, the balance comprises other fibres or blends of fibres suitable for use in garments such as polyester, for example. Preferably, the cellulosic fibres are of cotton or regenerated cellulose such as viscose.

The term "tumble dryer", as used herein, covers any device for drying wet fabric which causes the fabric to move, under the influence of gravity, through air at an elevated temperature, preferably by rotation of part of the device. Preferably, the tumble dryer is adapted for domestic use, rather than industrial or other large scale use. The products and compositions may be packaged and labelled for domestic use.

The laundering processes of the present invention include the large scale and small scale (eg domestic) cleaning of fabrics.

If the compositions of the present invention are in the form of fabric conditioner compositions, applied to the fabric from the fabric care product of the invention during tumble drying or using the sprayable composition of the invention before tumble drying, the textile-compatible carrier will be a fabric softening and/or conditioning compound (hereinafter referred to as "fabric softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula II:

(II)

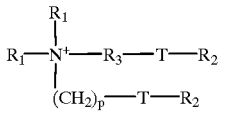

wherein each $R_1$ group is independently selected from $C_{1-4}$ alkyl or hydroxyalkyl groups or $C_{2-4}$ alkenyl groups; each $R_2$ group is independently selected from $C_{8-28}$ alkyl or alkenyl groups; and wherein $R_3$ is a linear or branched alkylene group of 1 to 5 carbon atoms, T is

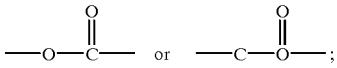

and p is 0 or is an integer from 1 to 5.

Di(tallowoyloxyethyl) dimethyl ammonium chloride and/or its hardened tallow analogue is especially preferred of the compounds of formula (II).

A second preferred type of quaternary ammonium material can be represented by the formula (III):

(III)

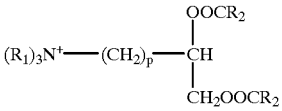

wherein $R_1$, p and $R_2$ are as defined above.

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof. Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, except in the sprayable compositions of the invention, such as predominantly linear polydialkylsiloxanes, e.g. polydimethylsiloxanes or amino-silicones containing amine-functionalised side chains. The compositions of the invention, including the sprayable compositions, may include soil release polymers such as block copolymers of polyethylene oxide and terephthalate; amphoteric surfactants; smectite type inorganic clays; zwitterionic quaternary ammonium compounds; and nonionic surfactants.

The fabric conditioning compositions may also include an agent which produces a pearlescent appearance, e.g. an organic pearlising compound such as ethylene glycol distearate, or inorganic pearlising pigments such as microfine mica or titanium dioxide ($TiO_2$) coated mica.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients in the fabric care products and sprayable compositions of the invention include non-aqueous solvents, perfume carriers, fluorescers, colourants, hydrotropes, antifoaming agents, antiredeposition agents, enzymes, optical brightening agents, dye transfer inhibitors, opacifiers, anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents and ironing aids. This list is not intended to be exhaustive.

The invention will now be described by way of example only and with reference to the following non-limiting examples.

EXAMPLES

The amine epichlorohydrin resin (PAE) used in the following tests is Kenores 1440® (ex. Akzo Nobel) which has an azetidinium functional group. It was prepared as an aqueous solution and utilised as a percentage of the weight of fabric treated (% on weight of fabric (owf)) to show its effect on colour definition.

Each load contained one garment which was a 100% knitted cotton childrens printed pyjama top having differently coloured areas bought from a Marks & Spencer store (Warrington, UK) together with 100% cotton sheeting to give a total load weight of approximately 2.0 kg.

Each load was given the following wash-dry cycles: Miele Novotronic W820® front loading washing machine, 40° C. cotton wash, short wash, Wirral water. 60 g Persil® biological washing powder added in the main wash. After washing each load was tumble dried in a Zanussi® tumble drier for between 70–90 minutes on high setting. All washing machines were boiled between washes to minimise contamination. All loads were alternated between washing machines to minimise effects arising from machine differences.

Each load was subjected to four wash-dry cycles before being assessed for its colour.

Example 1

Spray Application

Approximately 10 ml of a 2.5 wt % solution of PAE was sprayed onto the front of the garment between washing and tumble drying using a trigger sprayer to give a theoretical maximum amount of 0.61 wt % PAE on weight of fabric (owf) on the garment. The top was then placed directly into the tumble dryer along with the rest of the load.

Example 2

Application From a Sheet

A 30.5 cm×31.5 cm embossed polyester/rayon sheet was placed in a 13.5 wt % aqueous solution of PAE. The sheet absorbed 90–100 g PAE and was placed in the tumble dryer in amongst the rest of the load. The theoretical maximum amount of PAE delivered to the fabric from the sheet is 0.65% owf.

Example 3

Dosing Ball

A dosing ball 7.3 cm in height, 3 cm in diameter at its widest point and having four 1×2 mm apertures around its rim was used to deliver the PAE. 100 g of a 13.5 wt % aqueous PAE solution was placed in the dosing ball. The dosing ball was placed in the tumble dryer in the centre of the load. The dosing ball delivers the PAE to the fabric in a theoretical maximum amount of 0.68% owf.

Analysis and Results

The colour of three differently coloured regions of the garment (orange, light blue and green) was assessed as follows.

The colour of the garment was measured using a Datacolour Spectraflash SF600 reflectance spectrophotometer linked to a p.c., UV excluded specular included. Four measurements were taken for each colour and the colour difference values (ΔE) compared to the garment as purchased before washing were determined.

The result of the colour assessment, averaged over three experiments, are given in the following table:

| Example | ΔE (orange) | ΔE (light blue) | ΔE (green) |
|---|---|---|---|
| Control | 13.0 | 4.7 | 6.0 |
| 1 | 8.5 | 2.7 | 2.5 |
| 2 | 9.3 | 3.3 | 3.0 |
| 3 | 7.3 | 3.0 | 3.3 |

A lower ΔE value indicates a lower reduction in colour relative to the garment before washing. Therefore, colour benefits were obtained in Examples 1, 2 and 3.

What is claimed is:

1. A method for drying laundry in a tumble dryer comprising the steps of:

(i) adding the laundry to the tumble dryer;

(ii) adding to the tumble dryer a composition comprising at least one amide-epichlorohydrin resin or derivative thereof; and (iii) drying the laundry in the dryer wherein steps (i) and (ii) may be reversed or undertaken simultaneously and wherein during or before the laundry is dried, the composition is transferred to the laundry in the tumble dryer.

2. The method as claimed in claim 1 wherein the composition is associated with a substrate for delivery of the resin.

3. The method as claimed in claim 2 wherein the substrate is a flexible sheet or a sponge.

4. The method as claimed in claim 2 wherein the substrate is a dispenser.

5. The method as claimed in claim 4 wherein the dispenser comprises a receptacle which houses the resin, the receptacle having apertures therein for delivery of the resin during tumble drying.

6. The method as claimed in claim 2 wherein the substrate is a sachet comprising a carrier for the resin.

7. The method as claimed in claim 1 in which the composition is in the form of a liquid, semi-solid or solid foam.

8. The method as claimed in claim 1 wherein the composition further comprises a textile compatible carrier which facilitates contact between the resin and fabric.

9. The method as claimed in claim 1 in which the composition further comprises a silicone component.

10. The method as claimed in claim 1 wherein the amine or amide-epichlorohydrin resin or derivative thereof is present in the composition in an amount such that from 0.0005% to 5% by weight on weight of laundry is provided.

11. The method as claimed in claim 9 wherein the ratio of the resin to silicone component is from 1:1 to 30:1.

12. A method for reducing damage to fabrics in a tumble drying process comprising, the steps of:

(i) adding fabrics to a tumble dryer;

(ii) contacting the fabrics with a composition comprising at least one amide-epichlorohydrin resin or derivative thereof;

(iii) drying the fabrics.

13. The method for reducing damage to fabrics in a tumble drying process according to claim 12 wherein damage is color reduction, fuzzing, shrinkage, pill formation or reduction in fabric stability.

* * * * *